US011903468B2

(12) United States Patent
Goodwin et al.

(10) Patent No.: US 11,903,468 B2
(45) Date of Patent: Feb. 20, 2024

(54) MECHANICAL WALLET

(71) Applicant: Peter M. Goodwin, Spring Hill, TN (US)

(72) Inventors: Peter M. Goodwin, Spring Hill, TN (US); George Brooks, Spring Hill, TN (US); Cody Hutchins, Nashville, TN (US); Salmon Nortje, Cape Town (ZA); Graham Harrison, Spring Hill, TN (US)

( * ) Notice: Subject to any disclaimer, the term of this patent is extended or adjusted under 35 U.S.C. 154(b) by 0 days.

(21) Appl. No.: 17/728,832

(22) Filed: Apr. 25, 2022

(65) Prior Publication Data

US 2022/0248822 A1 Aug. 11, 2022

Related U.S. Application Data

(63) Continuation of application No. 17/410,122, filed on Aug. 24, 2021, now Pat. No. 11,344,091.

(60) Provisional application No. 63/078,593, filed on Sep. 15, 2020.

(51) Int. Cl.

| | |
|---|---|
| ***A45C 11/18*** | (2006.01) |
| ***A45C 13/18*** | (2006.01) |
| ***A45C 13/10*** | (2006.01) |
| ***A45C 13/00*** | (2006.01) |

(52) U.S. Cl.

CPC ..... *A45C 11/182* (2013.01); *A45C 13/005* (2013.01); *A45C 13/1069* (2013.01); *A45C 13/185* (2013.01)

(58) Field of Classification Search

CPC ... A45C 11/182; A45C 13/005; A45C 13/185; A45C 13/1069

See application file for complete search history.

(56) References Cited

U.S. PATENT DOCUMENTS

| | | | |
|---|---|---|---|
| 8,899,411 | B2 | 12/2014 | Van Geer |
| 10,178,901 | B2 | 1/2019 | Chan et al. |
| 10,201,216 | B2 | 2/2019 | Van Geer |
| 10,306,963 | B2 | 6/2019 | Van Geer |
| 10,646,014 | B2 | 5/2020 | Van Geer |
| 10,653,222 | B2 | 5/2020 | Scharnigg et al. |
| 10,667,588 | B2 | 6/2020 | Chan et al. |
| 10,765,188 | B2 | 9/2020 | Van Geer |
| 10,793,342 | B2 | 10/2020 | Minson et al. |
| 2005/0224149 | A1 | 10/2005 | Tiscione |
| 2014/0116896 | A1 | 5/2014 | Simmer |

(Continued)

FOREIGN PATENT DOCUMENTS

| | | | |
|---|---|---|---|
| EP | 0287532 | A | 10/1988 |
| JP | 10167370 | A | 6/1998 |

*Primary Examiner* — Sue A Weaver

(74) *Attorney, Agent, or Firm* — Eric B. Fugett; Mark A. Pitchford; Pitchford Fugett, PLLC

(57) ABSTRACT

A mechanical wallet or cardholder can be opened using one hand by sliding a top or second plate along rails parallel to a bottom or first plate. A card arm forces cards in the cardholder (i.e., located between the first and second plates) out a second end of the cardholder in a fanned or stepped fashion. A magnet in the card arm and in a first end of the frame (opposite the second end of the cardholder and frame) cooperate to return and retain the card arm and first plate in the closed position. A card lock at the second end of the frame retains cards in the cardholder when the cardholder is in the closed position and allows the cards to be pushed from the second end of the cardholder by the card arm when the second plate is moved to the open position.

22 Claims, 11 Drawing Sheets

(56) References Cited

U.S. PATENT DOCUMENTS

| | | | |
|---|---|---|---|
| 2015/0041032 | A1 | 2/2015 | Broly |
| 2019/0133272 | A1 | 5/2019 | Van Geer |
| 2020/0178657 | A1 | 6/2020 | Van Geer |
| 2020/0315308 | A1 | 10/2020 | Van Geer |

MECHANICAL WALLET

CROSS-REFERENCES TO RELATED APPLICATIONS

This Non-provisional Patent Application is a continuation of U.S. patent application Ser. No. 17/410,122, filed Aug. 24, 2021 and titled "MECHANICAL WALLET," which issued as U.S. Pat. No. 11,344,091 on May 31, 2022 and which claims priority to U.S. Provisional Patent Application No. 63/078,593, filed Sep. 15, 2020 and titled "MECHANICAL WALLET", the entire disclosure of each of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to wallets for holding cards (e.g., credit cards, driver's licenses, etc.) and foldable cash. More particularly, this invention pertains to a wallet including a mechanical cardholder configured to fan out cards retained by the cardholder.

Most people carry with them a number of standard sized cards every day including credit cards, health insurance cards, government licenses, business cards, and other useful identification. Sorting through cards can be time consuming. Leather wallets display such cards in a stepped fashion by including a separate pocket for each card or utilizing a binder style clear book. Mechanical wallets or cardholders store the cards in a common pocket and fan them out for viewing and selection. Existing mechanical wallets or cardholders are based on levers that must be manually returned to a closed position and/or springs that return the wallet to a closed position. These springs wear out and break over time rendering the wallet inoperable for holding or displaying cards. Additionally, two hands are required to operate such wallets and display the cards contained therein. Two hands are also required to close the cardholder (i.e., return the lever to the closed position) and push the cards back into the cardholder. Some mechanical cardholders combine a mechanical cardholder with a money clip to hold paper bills in addition to standard cards. However, these tend to be overly bulky as they protrude impractically far from the cardholder and are not removable therefrom. What is needed are improvements in mechanical wallets and cardholders.

BRIEF SUMMARY OF THE INVENTION

Aspects of the present invention provide a mechanical wallet or cardholder that can be opened using one hand by sliding a top or second plate along rails parallel to a bottom or first plate. A card arm forces cards in the cardholder (i.e., located between the first and second plates) out a second end of the cardholder in a fanned or stepped fashion. The cardholder is closed by returning the second plate to the closed position. A magnet in the card arm and in a first end of the frame (opposite the second end of the cardholder and frame) cooperate to return and retain the card arm and first plate in the closed position. A card lock at the second end of the frame retains cards in the cardholder when the cardholder is in the closed position and allows the cards to be pushed from the second end of the cardholder by the card arm when the second plate is moved to the open position.

In one aspect, a cardholder has an open position and a closed position. The cardholder includes a pair of opposing plates, a frame, and a card arm. The pair of opposing plates are configured to receive a plurality of cards therebetween. The pair of opposing plates includes a first plate and a second plate. The first plate has a first end corresponding to a first end of the cardholder and a second end opposite the first end corresponding to a second end of the cardholder. The second plate has a first end corresponding to the first end of the cardholder and a second end opposite the first end corresponding to the second end of the cardholder. The frame is configured to space the pair of opposing plates from one another and limit motion of the plates relative to one another to parallel movement along one axis between the open position and the closed position. The card arm is disposed between the pair of opposing plates and hingedly engages the first plate at the first end of the first plate. The card arm is configured to push at least one of the plurality of cards beyond the second end of the first plate as the cardholder is moved from the closed position to the open position.

In another aspect, a cardholder has an open position and a closed position. The cardholder includes a pair of opposing plates, a frame, a card arm, a pair of magnets, and a card lock. The pair of opposing plates are configured to receive a plurality of cards therebetween. The pair of opposing plates includes a first plate and a second plate. The first plate has a first end corresponding to a first end of the cardholder and a second end opposite the first end corresponding to a second end of the cardholder. The second plate has a first end corresponding to the first end of the cardholder and a second end opposite the first end corresponding to the second end of the cardholder. The frame is configured to space the pair of opposing plates from one another and limit motion of the plates relative to one another to parallel movement along one axis between the open position and the closed position. The card arm is disposed between the pair of opposing plates and hingedly engages the first plate at the first end of the first plate. The card arm is configured to push at least one of the plurality of cards beyond the second end of the first plate as the cardholder is moved from the closed position to the open position. The pair of magnets is configured to bias the card arm to the closed position. The card lock is hingedly disposed between the pair of opposing plates and hingedly engages at least one of the first plate, the second plate, or the frame at the second end of the first plate. The card lock is configured to prevent cards in the cardholder from exiting the second end of the cardholder when the cardholder is in the closed position and allow cards in the cardholder to exit the second end of the cardholder when the cardholders in the open position. Movement of the second plate relative to the first plate along the axis in a first direction moves the card arm from the closed position to the open position and moves the card lock from the closed position to the open position. Cards are insertable into and removable from the cardholder at the second end of the cardholder when the cardholder is in the open position. Movement of the card arm from the open position to the closed position moves the second plate relative to the first plate along the axis in a second direction opposite the first direction and moves the card lock from the open position to the closed position.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein where the mechanical wallet is in a closed position with the first plate generally horizontal and below the second plate without cards protruding out of the second end of the mechanical wallet (and misaligning the card lock from the frame rail that the card lock is at the second end of). Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Figure 1:
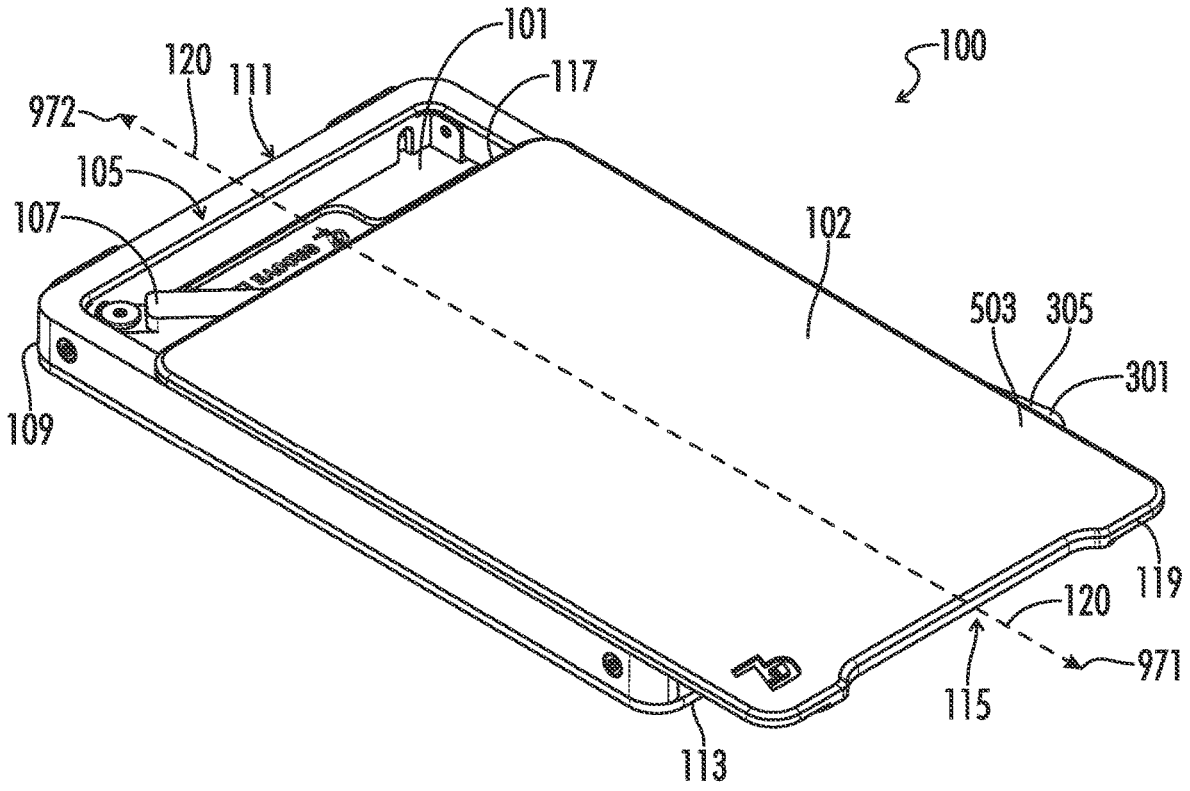
FIG. 1 is a top isometric view of an embodiment of a mechanical wallet (i.e., cardholder) formed in accordance with the present invention shown in an open position.
Figure 2:
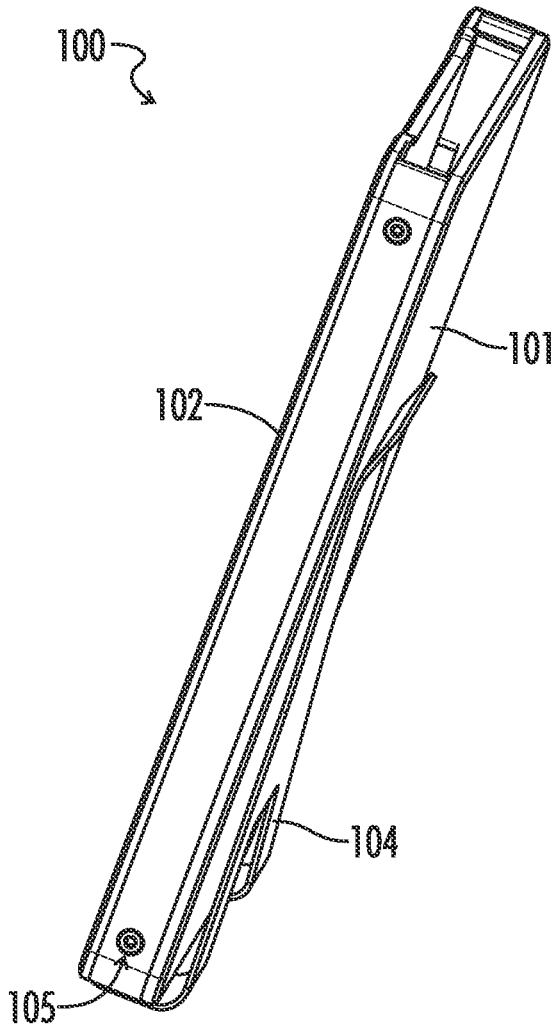
FIG. 2 is a bottom isometric view of the cardholder of FIG. 1 including a money clip.
Figure 3:
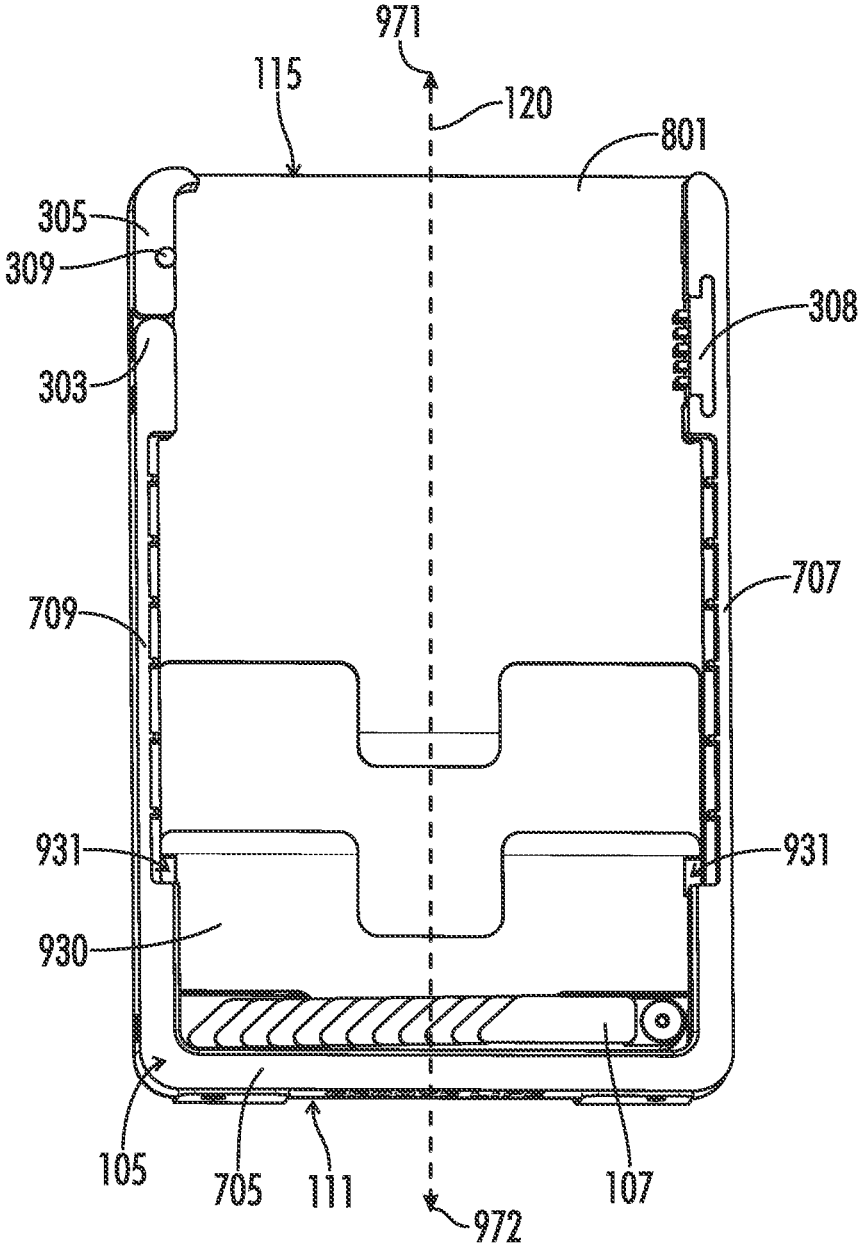
FIG. 3 is a top perspective view of the cardholder of FIG. 1 in the closed position with the top plate (i.e., second plate) removed to expose the bottom plate (i.e., first plate).
Figure 4:
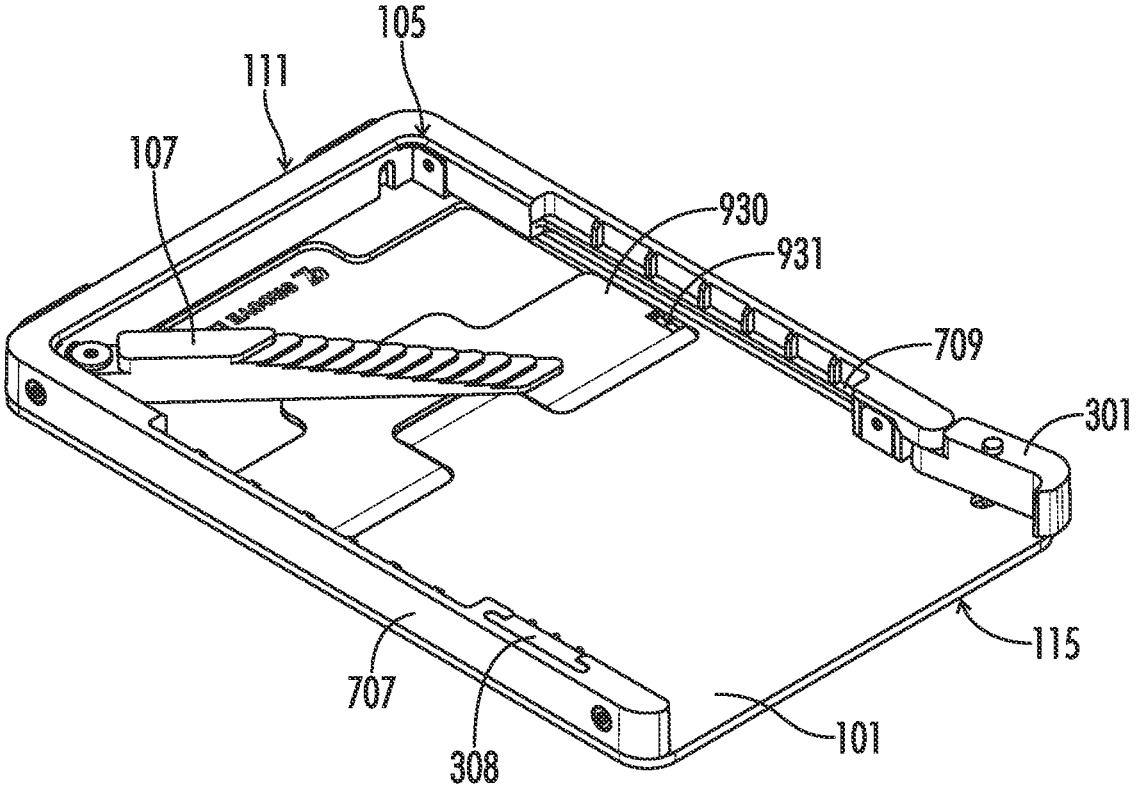
FIG. 4 is an isometric view of the cardholder of FIG. 3 in an open position with the top plate (i.e., second plate) removed to expose the bottom plate (i.e., first plate).
Figure 5:
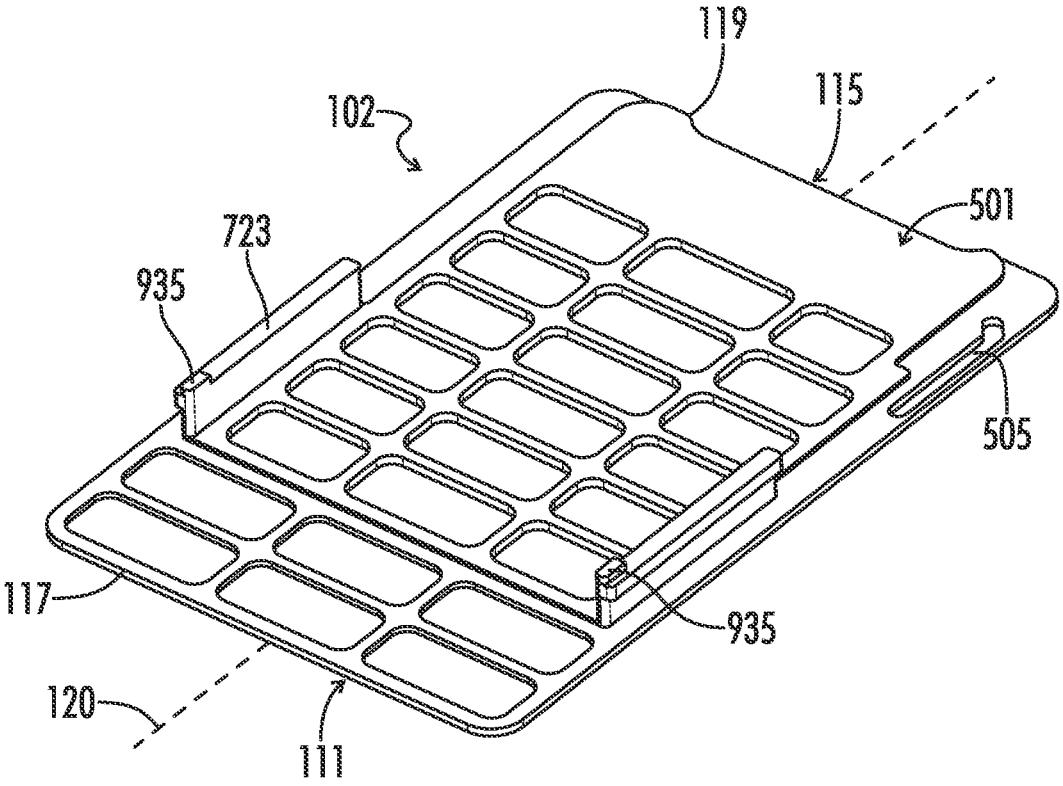
FIG. 5 is a bottom isometric view of the top plate (i.e., second plate) of the cardholder of FIGS. 1-5.
Figure 6:
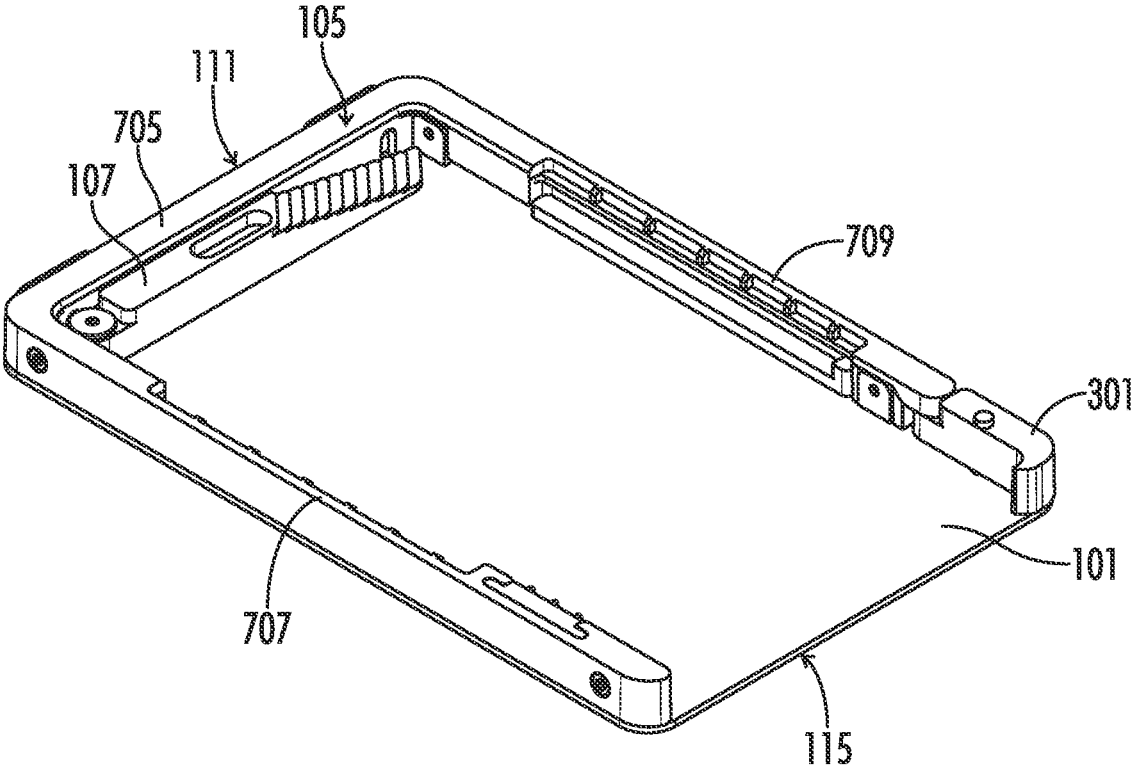
FIG. 6 is a top isometric view of another embodiment of a cardholder formed in accordance with the present invention showing the cardholder in a closed position with the top plate (i.e., second plate) removed to expose the bottom plate (i.e., first plate).
Figure 7:
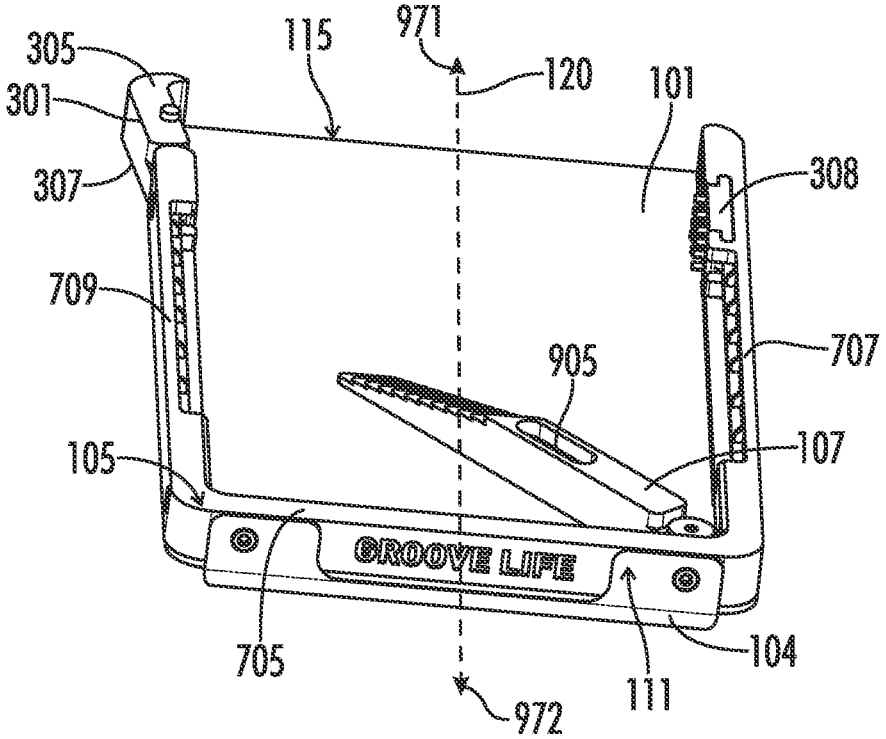
FIG. 7 is an elevated perspective view of the cardholder of FIG. 6 in an open position with the top plate (i.e., second plate) removed to expose the bottom plate (i.e., first plate).
Figure 8:
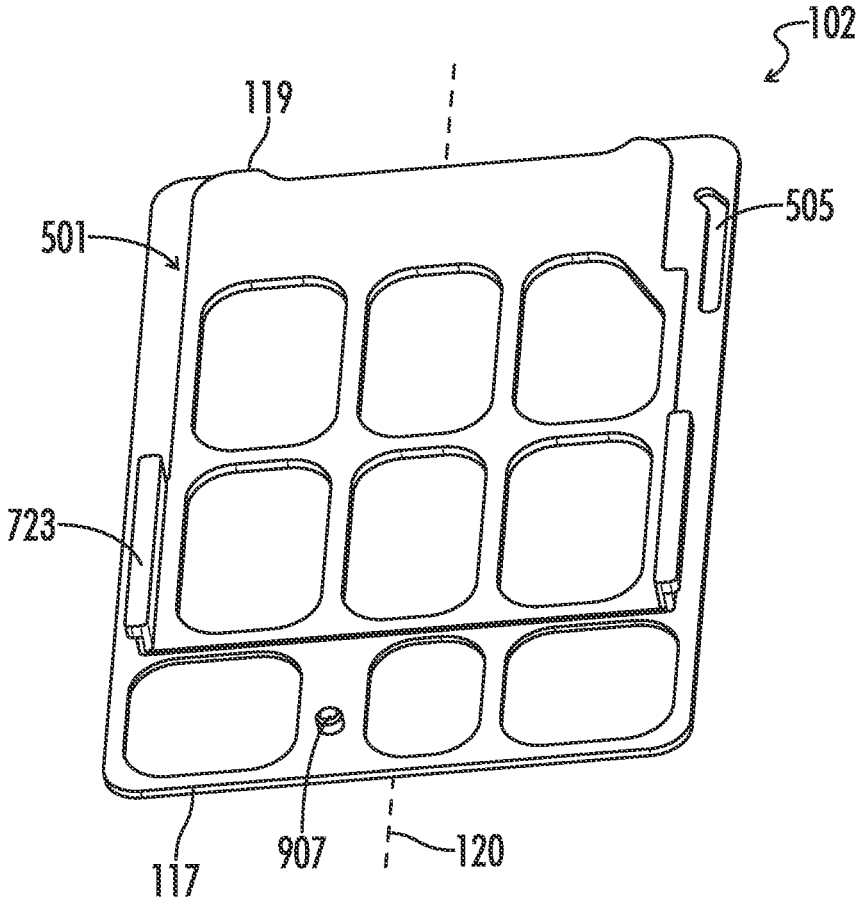
FIG. 8 is a bottom isometric view of the top plate (i.e., second plate) of the cardholder of FIGS. 6 and 7.
Figure 9:
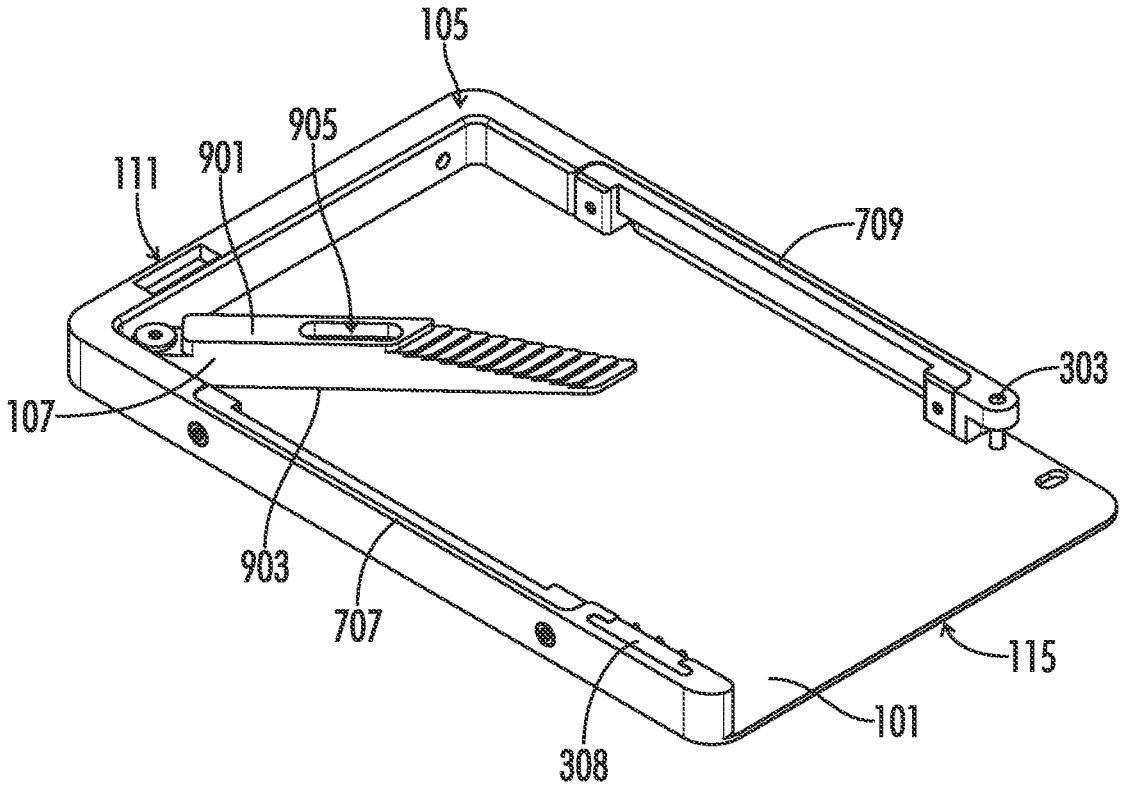
FIG. 9 is an isometric view of another embodiment of a cardholder formed in accordance with the present invention showing the cardholder in an open position with the top plate (i.e., second plate) removed to expose the bottom plate (i.e., first plate).
Figure 10:
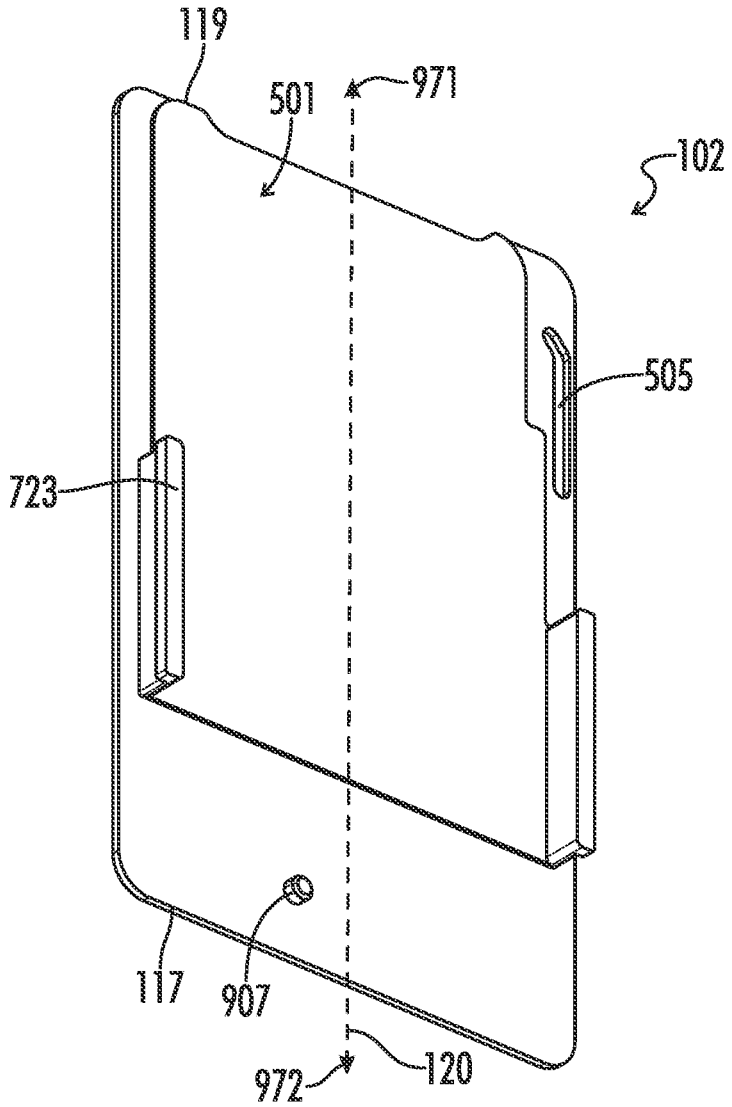
FIG. 10 is a bottom isometric view of the top plate (i.e., second plate) of the cardholder of FIG. 9.
Figure 11:
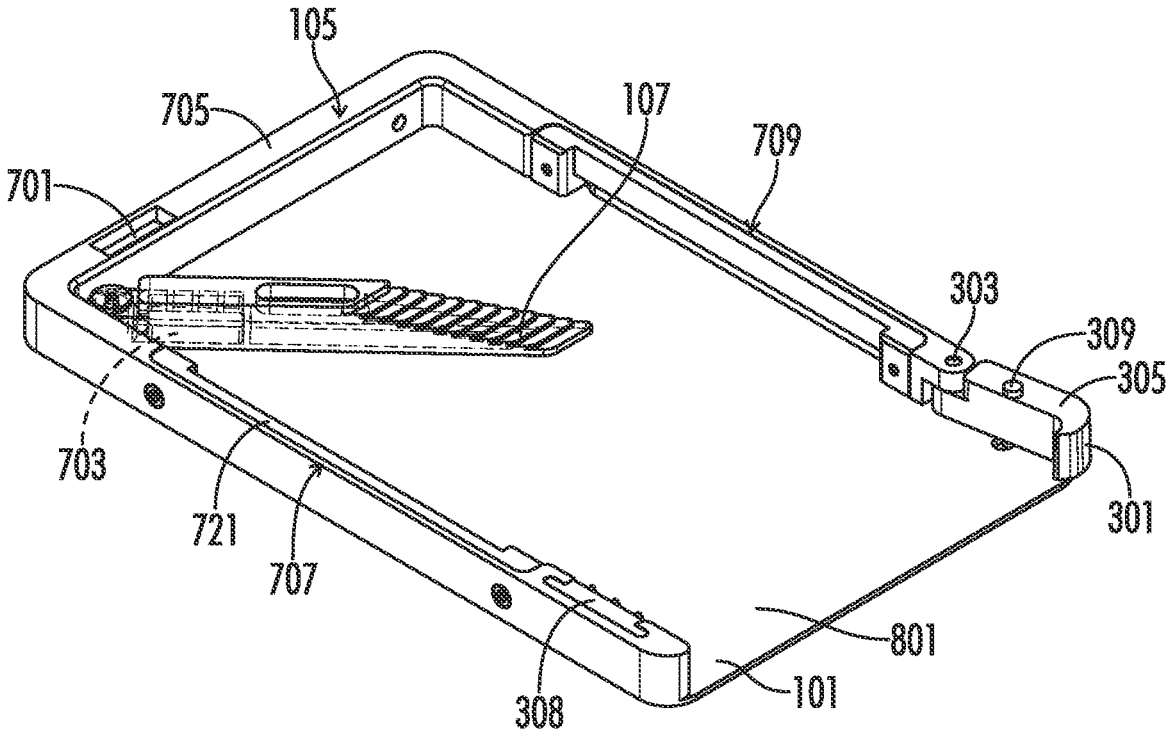
FIG. 11 is a top isometric view of the cardholder of FIG. 9 in an open position with the top plate (i.e., second plate) removed to expose the bottom plate (i.e., first plate) and the card arm shown in transparency.

Referring now to FIGS. 1-11, a mechanical wallet or cardholder 100 includes a pair of opposing plates 101, 102, a frame 105, and a card arm 107. The pair of opposing plates 101, 102 is configured to receive a plurality of cards therebetween. As used herein, cards means credit cards, licenses, health insurance cards, or any other such standard sized card (e.g., business cards). The first plate 101 has a first end 109 corresponding to a first end 111 of the cardholder 100 and a second end 113 opposite the first end 109 corresponding to a second end 115 of the cardholder 100. The second plate 102 has a first end 117 corresponding to the first end 111 of the cardholder 100 and a second end 119 opposite the first end 117 corresponding to the second end 113 of the cardholder 100. The frame 105 is configured to space the pair of opposing plates 101, 102 from one another and limit motion of the plates relative to one another to parallel movement along one axis 120 between the open position and the closed position. In an embodiment, the cardholder 100 includes a money clip 104. The money clip 104 can be integrally formed with or detachable from one of the plates 101,102 or the frame 105.

The card arm 107 is disposed between the pair of opposing plates 101, 102 and hingedly engages the first plate 101 at the first end 109 of the first plate 101. The card arm 107 is configured to push at least one of the plurality of cards in the cardholder 100 beyond the second end 113 of the first plate 101 as the cardholder 100 is moved from the closed position to the open position (i.e., as the second plate 102 is slid along the frame 105 along the axis 120). In one embodiment, the card arm 107 is stepped such that the card arm 107 is shorter at the second plate 102 than at the first plate 101 and cards pushed out of the second end 115 of the cardholder 100 by the card on 107 when the cardholder 100 is opened (i.e., moved to the open position) are stepped or fanned. The card arm 107 has a top 901 facing the second plate 102 and a bottom 903 facing the first plate 101.

In one embodiment, the card arm 107 includes a card arm groove 905 recessed into the top 901 of card arm 107 or a card arm pin 907 extending from the top 901 of the card arm 107 away from the bottom 903 of the card arm 107. The second plate 102 has a bottom face 501 proximal to the card arm 107 and a top face 503 distal to the card arm 107. If the card arm 107 has the card arm groove 905, then the second plate 102 has the card arm pin 907 extending downward from the bottom face 501 of the second plate 102 into the card arm groove 905 in the top 901 of the card arm 107. If the card arm has the card arm pin 907, then the second plate 102 has the card arm groove 905 recessed into the bottom face 501 of the second plate 102, and the card arm groove 905 is configured to receive the card arm pin 907 extending up from the top 901 of the card arm 107 away from the bottom 903 of the card arm 107.

In one embodiment, the cardholder 100 further includes a pair of magnets 701, 703 configured to bias the card arm 107 to the closed position of the cardholder 100. In one embodiment, the pair of magnets includes a first magnet 701 attached to the frame 105 at the first end 111 of the cardholder 100 and a second magnet 703 attached to the card arm 107. In one embodiment, the first magnet 701 is at least partially embedded in the frame 105, and the second magnet 703 is at least partially embedded into the card arm 107. In one embodiment, the frame 105 includes an end wall 705 at the first end 111 of the cardholder 100 and a pair of opposing frame rails 707, 709 extending generally parallel to the axis 120. The first magnet 701 is at least partially embedded into the end wall 705.

In one embodiment, the cardholder 100 further includes a card lock 301 hingedly disposed between the pair of opposing plates 101, 102. The card lock 301 is configured to prevent cards in the cardholder 100 from exiting the second end 115 of the cardholder 100 when in the closed position and to allow cards in the cardholder 100 to exit the second end 115 of the cardholder 100 when the cardholder is in the open position. The card lock 301 has a hinged connection to at least one of the first plate 101, the second plate, 102, or the frame 105. The card lock 301 has an axis of rotation 303 that is generally perpendicular to the first plate 101.

In one embodiment, the card lock 301 has a top 305 facing the second plate 102 and a bottom 307 facing the first plate 101. The card lock 301 includes a card lock groove 505 recessed into the top 305 of the card lock or a card lock pin 309 extending from the top 305 of the card lock 301 away from the bottom 307 of the card lock 301. The second plate 102 has a bottom face 501 proximal to the card lock 301 and a top face 503 distal to the card lock 301. When the card lock 301 has the card lock groove 505, the second plate 102 includes the card lock pin 309 extending downward from the bottom face 501 of the second plate 102 into the card lock groove 505 in the top 305 of the card lock 301. When the card lock 301 has the card lock pin 309, the second plate 102 has the card lock groove 505 recessed into the bottom face 501 of the second plate 102 which is configured to receive the card lock pin 309 extending up from the top 305 of the card lock 301 away from the bottom 307 of the card lock 301.

In one embodiment, the card lock groove 505 has a second end closer to the second end 115 of the cardholder 100 than a first end of the card lock groove 505. Similarly, the card lock 301 has a first end closer to the first end 115 of the cardholder 100 than a second end of the card lock 301. The card lock groove 505 is closer to the axis 120 at the second end of the card lock groove 505 than at the first end of the card lock groove 505 such that as the cardholder 100 is moved to the closed position from the open position, the card lock pin 309 and card lock groove 505 cooperate to force the card lock 301 into the closed position which has a second end of the card lock 301 at the second end of the cardholder closer to the first frame rails 707 then when the cardholder 100 is in the open position. The card lock 301 is closer to the first frame rails 707 at the second end of the card lock 301 than at the first end of the card lock 301 when the cardholder 100 is in the closed position such that the card lock is generally hook shaped.

In one embodiment, the frame 105 includes the end wall 705 at the first end 111 of the cardholder 100 and the pair of opposing frame rails 707, 709 (i.e., opposing rails 707, 709) extending generally parallel to the axis 120. The end wall 705 extends generally perpendicularly to the longitudinal axis 120 and is attached or affixed to the top face 801 of the first plate 101 at the first end 111 of the cardholder 100. In one embodiment, the frame 105 further includes a friction element 308 configured to prevent cards from falling out of the second end 115 of the cardholder 100 under the force of gravity when the cardholder 100 is in the open position with the second end 115 of the cardholder 100 facing downward. The friction element 308 includes a plurality of flexible (i.e., resiliently flexible) protrusions extending laterally (i.e., generally perpendicular to longitudinal axis 120) from a first frame rail 707 of the pair of opposing frame rails toward a second frame rail 709 of the pair of opposing rails (i.e., opposing frame rails 707, 709).

In one embodiment, each rail 707, 709 includes a fixed portion 721 and a movable portion 723. The fixed portion 721 of each frame rail of the pair of opposing frame rails 707, 709 of the frame 105 is attached to a top face 801 of the first plate 101. The movable portion 723 of each frame rail of the pair of opposing frame rails 707, 709 of the frame 105 is attached to the bottom face 501 of the second plate 102 and engages the fixed portion 721 of the rail to maintain a distance between the first plate 101 and the second plate 102 within a predetermined range while allowing movement of the second plate 102 relative to the first plate 101 within a predetermined range along the axis 120 between the open position and the closed position of the cardholder 100.

In one embodiment, the cardholder 100 further includes an arm cam 930 positioned between the first plate 101 and the card arm 107. The arm cam 930 includes the card arm pin 907 engaging the card arm groove 905 in the bottom surface 903 of the card arm 107 and a pair of slider holes 931 at opposing lateral sides of the arm cam 930. In this embodiment, the movable portion 723 of each frame rail of the pair opposing frame rails 707, 709 includes a protrusion 935 at a first end of the movable portion 923 configured to engage a corresponding slider hole 931 of the pair of slider holes in the arm cam 930 such that movement of the second plate 102 relative to the first plate 101 is transferred from the second plate 102 to the movable portion of each frame rail 723 of the pair of opposing frame rail 707, 709, from the movable portion of each frame rail of the pair of opposing frame rails to the protrusion 935 at the first end of each movable portion of each frame rail of the pair of opposing frame rails of the frame 105, from the protrusion 935 at the first end of each movable portion of each frame rail of the pair opposing frame rails of the frame to the arm cam 930, from the arm cam 932 to the card arm pin 907, and from the card arm pin 907 to the card arm 107 via the card arm groove 505 in the bottom 903 of the card arm 107.

In one embodiment, movement of the second plate 102 relative to the first plate 101 along the axis 120 in a first direction 971 moves the card arm 107 from the closed position to the open position and moves the card lock 301 from the closed position to the open position. Movement of the second plate 102 relative to the first plate 101 along the axis 120 in a second direction 972 opposite the first direction 971 moves the card arm 107 from the open position to the closed position and moves the card lock 301 from the open position to the closed position.

In some embodiments, magnets 701, 703 maintain the second plate 102, the card arm 107, and the card lock 301 in the closed position until a user manually moves the second plate 102 along the axis 120 in the first direction 971. Then, once the user has released the second plate 102 (i.e., ceased manually urging the second plate 102 relative to the first plate 101 along the axis 120 in the first direction 971), magnets 701, 703 automatically move the second plate 102 relative to the first plate 101 along the axis 120 in the second direction 972 to automatically return the second plate 102, the card arm 107, and the card lock 301 to the closed position.

To explain, a magnetic attraction between the magnets 701, 703 causes the second magnet 703 to be attracted to the first magnet 701. As such, the magnet 703 in the card arm 107 is attracted to the magnet 701 in the frame 105. The magnetic attraction between magnets 701, 703 causes the magnet 703 in the card arm 107 to bias the card arm 107 toward the magnet 701 in the frame 105 at the first end 111 of the cardholder 100. This in turn biases the second plate 102 and card lock 301 toward the closed position because the second plate 102 and card lock 301 are operatively connected to the card arm 107 as described herein. This maintains the card arm 107, second plate 102, and card lock 301 in the closed position until a user manually moves the second plate 102 along the axis 120 in the first direction 971 to move the card arm 107 into the open position. The magnetic attraction between magnets 701, 703 then causes the card arm 107, second plate 102, and card lock 301 to automatically revert to the closed position once a user has released the second plate 102. As such, the magnets 701, 703 maintain tension on the system and thereby maintain the cardholder 100 in the closed position until such time as the user desires to activate the cardholder 100 by moving the second plate 102 to the open position.

In one embodiment, in the open position, cards may be inserted into and/or removed from the second end 115 of the cardholder 100. In the closed position, cards can be inserted into the second end 115 of the cardholder 100 by pushing the card lock 301 and friction element 308 apart, but cards may not be removed from the cardholder 100 because of the hook action of the card lock 301 and lack of access caused by the coverage of the second plate 102. In one embodiment, cycling the cardholder 100 from the closed position to the open position and back to the closed position leaves the cards extended from the second end 115 of the cardholder 100 in a stepped or fanned fashion until the cards are pushed back into the cardholder. The flexibility and resiliency of the friction element 308 allows the card lock 301 to be returned to the closed position with the cards extended from the second end 115 of the cardholder 100. The friction element 308 can be formed from any suitably flexible and resilient material, including but not limited to, one or more elastomeric materials or a combination of elastomeric materials.

In one embodiment, the first magnet 701 and second magnet 703 are neodymium; the friction element 308 is silicone; and the frame 105, card arm 107, and opposing plates 101, 102 are aluminum. Alternatively, some or all of the frame 105, card arm 107, and opposing plates 101, 102 may be made of other non-magnetic materials such as plastics. In one embodiment, portions of the frame 105 are integral with the plate (i.e., first plate 101 or second plate 102) to which they are attached or affixed.

Although shown in FIGS. 1-11 as being lengthwise, it should be appreciated by one of ordinary skill in the art that the axis 120 may run widthwise such that the second end 115 of the cardholder 100 from which cards are inserted or removed extends laterally further than the cardholder 100 extends longitudinally.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful MECHANICAL WALLET it is not intended that such references be construed as limitations upon the scope of this invention except as set forth in the following claims.

What is claimed is:

1. A cardholder, comprising:

a first plate;

a second plate;

a frame connected to each of the first plate to and the second plate, the frame configured to:

space the second plate from the first plate such that a plurality of cards is receivable between said plates, and limit relative motion of said plates to parallel movement along one axis; and a card arm disposed between said plates, the card arm operatively arranged to push the plurality of cards at least partially out of one end of the cardholder when the second plate is moved along the axis relative to the first plate in a direction toward said end of the cardholder.

2. The cardholder of claim 1, wherein:

the axis extends from a first end of the cardholder to a second end of the cardholder opposite the first end; and the one end of the cardholder out of which the card arm is operatively arranged to at least partially push the plurality of cards is the second end of the cardholder.

3. The cardholder of claim 1, wherein the axis is a longitudinal axis of the cardholder.

4. The cardholder of claim 1, wherein the frame limits movement of the second plate to movement along the axis between an open position and a closed position.

5. The cardholder of claim 1, wherein the card arm pivotably engages or is pivotably engaged by at least one of said plates.

6. The cardholder of claim 1, further comprising:

a first magnet on the frame; and a second magnet on the card arm;

wherein the card arm is magnetically maintained in a closed position until the second plate is moved along the axis in the direction toward said end of the cardholder.

7. The cardholder of claim 1, further comprising:

a first magnet on the frame; and a second magnet on the card arm;

wherein the magnets are arranged to bias the card arm to a closed position.

8. The cardholder of claim 1, wherein:

the frame comprises:

a pair of opposing frame rails extending parallel to the axis, and an end wall at the first end of the cardholder extending perpendicularly to the axis; and the cardholder further comprises a first magnet on the end wall of the frame.

9. The cardholder of claim 1, wherein cards pushed out of the second end of the cardholder by the card arm when the second plate is moved along the axis in the direction toward said end of the cardholder are stepped.

10. The cardholder of claim 9, wherein the card arm is shorter at the second plate than at the first plate.

11. A cardholder, comprising:

a first plate;

a second plate spaced from the first plate so as to receive a plurality of cards therebetween;

a frame connected to each of the first plate to and the second plate, the frame configured to limit motion of the second plate relative to the first plate to movement along one axis, the axis extending from a first end of the cardholder to a second end of the cardholder opposite the first end; and a card arm disposed between said plates, the card arm operatively arranged to push the plurality of cards beyond the second end of the cardholder as the second plate is moved along the axis relative to the first plate toward the second end of the cardholder.

12. The cardholder of claim 11, further comprising:

a first magnet on the frame; and a second magnet on the card arm;

wherein the card arm is magnetically maintained in a closed position until the second plate is moved along the axis toward the second end of the cardholder.

13. The cardholder of claim 11, further comprising:

a first magnet attached to the frame; and a second magnet attached to the card arm;

wherein the magnets are arranged to bias the card arm to a closed position.

14. The cardholder of claim 11, further comprising:

a first magnet on the frame; and a second magnet on the card arm;

wherein the card arm engages or is engaged by the second plate; and wherein the magnets are arranged to bias the second plate to a closed position.

15. The cardholder of claim 11, wherein cards pushed beyond the second end of the cardholder by the card arm when the second plate is moved along the axis toward the second end of the cardholder are stepped.

16. The cardholder of claim 11, wherein the card arm is pivotably engaged with at least one of said plates.

17. A cardholder having an open position and a closed position, said cardholder comprising:

a pair of opposing plates configured to receive a plurality of cards therebetween, wherein the pair of opposing plates comprises:

a first plate having a first end corresponding to a first end of the cardholder and a second end opposite the first end corresponding to a second end of the cardholder; and a second plate having a first end corresponding to the first end of the cardholder and a second end opposite the first end corresponding to the second end of the cardholder;

a frame connected to each of the first plate to and the second plate, said frame configured to limit motion of the plates relative to one another to parallel movement along one axis; and a card arm disposed between the pair of opposing plates, the card arm operatively engaged with the second plate so as to push the plurality of cards beyond the second end of the first plate as the cardholder is moved from the closed position to the open position;

wherein moving the cardholder from the closed position to the open position comprises moving the second plate along the axis such that the first end of the second plate is closer to the second end of the first plate than in the closed position of the cardholder.

18. The cardholder of claim 17, further comprising:

a first magnet on the frame; and a second magnet on the card arm;

wherein the cardholder is magnetically maintained in the closed position until the second plate is moved along the axis in a direction away from the first end of the first plate.

19. The cardholder of claim 17, further comprising:

a first magnet attached to the frame at the first end of the cardholder; and a second magnet attached to the card arm;

wherein the magnets are arranged to bias the card arm to the closed position.

20. The cardholder of claim 19, wherein:

the frame comprises:

a pair of opposing frame rails extending parallel to the axis; and an end wall at the first end of the cardholder extending perpendicularly to the axis; and the first magnet is at least partially embedded in the end wall of the frame; and the card arm is in the closed position when the card arm is adjacent the end wall of the frame.

21. A cardholder having an open position and a closed position, said cardholder comprising:

a first plate;

a second plate;

a frame connected to each of the first plate to and the second plate, the frame configured to space the second plate from the first plate such that a plurality of cards is receivable between said plates;

a card arm disposed between said plates, the card arm operatively arranged to push the plurality of cards at least partially out of one end of the cardholder as the cardholder is moved from the closed position to the open position; and a card lock disposed between said plates at said end of the cardholder, the card lock configured to prevent cards from exiting the cardholder when the cardholder is in the closed position and allow cards to exit the card holder when the cardholder is in the open position.

22. The cardholder of claim 21, wherein:

the card lock is hingedly connected to at least one of the first plate, the second plate, and the frame; and the card lock has an axial rotation that is perpendicular to the first plate;

the card lock blocks the cards from exiting said end of the cardholder when the cardholder is in the closed position; and moving the cardholder from the closed position to the open position comprises activating the card arm to push the plurality of cards at least partially out of one end of the cardholder.

* * * * *